US006067738A

United States Patent [19]

Zeligson

[11] Patent Number: 6,067,738

[45] Date of Patent: May 30, 2000

[54] REFRIGERATOR DOOR DISPLAY LENS

[76] Inventor: Stephen J. Zeligson, 1815 E. 31st Pl., Tulsa, Okla. 74105

[21] Appl. No.: 08/712,913

[22] Filed: Sep. 12, 1996

Related U.S. Application Data

[60] Provisional application No. 60/003,689, Sep. 13, 1995.

[51] Int. Cl.[7] ..... G09F 7/02

[52] U.S. Cl. ..... 40/611; 40/600; 40/772

[58] Field of Search ..... 40/611, 600, 772; 312/138.1, 321.5, 292

[56] References Cited

U.S. PATENT DOCUMENTS

| | | | |
|---|---|---|---|
| 1,465,244 | 8/1923 | Hager . | |
| 1,505,843 | 8/1924 | Banta . | |
| 1,726,282 | 8/1929 | Winter . | |
| 4,449,761 | 5/1984 | Davis et al. . | |
| 5,309,659 | 5/1994 | Eastman . | |
| 5,509,225 | 4/1996 | Minh et al. | 40/611 |

*Primary Examiner*—Cassandra H. Davis
*Attorney, Agent, or Firm*—Frank J. Catalano

[57] ABSTRACT

A clear plastic, PLEXIGLAS® or other suitable, clear, "unbreakable" lens may be either hingedly opened from and closed to or otherwise removed from and replaced in laminar relationship with respect to a refrigerator/freezer door. Adhesive, magnetic or other suitable fastening material are used to fix display items to the lens or door. When the lens closes over the items a visually pleasing frame protects the displayed items and allows for easy removal and substitution. In one embodiment, the lens is hinged to one side of a freezer door on an upright, top-freezer refrigerator. In a second embodiment, lenses are hinged to the outside edges and latched on the inside edges of both doors of an upright, side-by-side double-door refrigerator/freezer combination. In either embodiment, the lens can be inset into the door so as to provide surfaces on the same planes as those of the remainder of the door. In a third and aftermarket embodiment, a sheet of relatively rigid material, such as plastic, aluminum or sheet metal, is attached to an existing refrigerator/freezer door by means of two-sided tape, magnets or other suitable fastening material. A sheet of magnetic material may be used. The lens is mounted to the sheet and pictures and other printed matter are mounted on the sheet instead of being mounted directly on the refrigerator/freezer door.

10 Claims, 2 Drawing Sheets

REFRIGERATOR DOOR DISPLAY LENS

This application claims the benefit of U.S. Provisional Application No. 60/003,689, filed Sep. 13, 1995.

BACKGROUND OF THE INVENTION

This invention relates generally to refrigerators and more particularly concerns doors for household refrigerators.

Displaying pictures, calendars, messages and other printed matter on the front of home refrigerators is becoming increasingly popular. They are usually held in place on the refrigerator door in haphazard arrangement by two-sided tape or magnets. The resulting messy and disorganized appearance and even the ultimate damage to the displayed items sometimes including treasured pictures and the like are really an unacceptable sacrifice to convenience. Still, while modern refrigerator doors dispense water and ice from a variety of colored facades, they make no provision whatsoever for tidying up this family center for artifacts and messages.

It is, therefore, an object of this invention to provide an improved refrigerator door suited to the neat and organized display of personally selected printed materials and information. It is also an object of this invention to provide an improved refrigerator door having a removable lens through which selected printed materials and information can be displayed. A further object of this invention is to provide an improved refrigerator door having a removable transparent sheet for securing selected printed materials and information in a neat and organized fashion. Yet another object of this invention is to provide a lens assembly which can be attached to existing refrigerator doors to likewise accomplish the above objectives.

SUMMARY OF THE INVENTION

In accordance with the invention, a clear plastic, PLEXIGLAS® or other suitable, clear unbreakable a clear plastic, PLEXIGLAS® or other suitable, clear, "unbreakable" lens may be either hingedly opened from and closed to or otherwise removed from and replaced in laminar relationship with respect to a refrigerator door. Adhesive, magnetic or other suitable materials, preferably "dots" or "squares" of two-sided tape, affix the display items to the lens or, preferably, the door, or, in the case of an aftermarket embodiment, to a panel which is affixed to the door. When the lens closes over the items, a visually pleasing frame protects the displayed items and secures them in place. The lens may be opened for easy removal and substitution of the displayed items.

In one embodiment, the lens is hinged to one side of a freezer door on an upright, top-freezer refrigerator. The lens wraps around one or more of the top, bottom and unhinged sides of the freezer door to increase rigidity of the lens. A suitable latch secures the lens in its closed condition on the freezer door. For a single-door upright refrigerator, the lens does not wrap around on the bottom. Preferably, on a single door refrigerator, the lens is inset into the door so as to provide front and side surfaces on the same planes as those of the door.

In a second embodiment, lenses are attached to one or both doors of an upright, side-by-side double-door refrigerator/freezer combination. Preferably, two lenses are provided, one hinged to the outside edge and latched on the inside edge of each of the doors.

In a third embodiment, a sheet of relatively rigid material, such as plastic, aluminum or sheet metal, is attached to an existing refrigerator door by means of two-sided tape, magnets or other suitable means. Alternatively, a sheet of magnetic material may be used. Pictures and other printed matter are mounted on the sheet. The lens is mounted to the sheet in much the same manner as it is mounted directly to the refrigerator door in the preceding embodiments, such as by a "piano" hinge, and closes by means of a latch on the opposite side. This assembly is an "aftermarket" version to be mounted on existing refrigerator doors.

BRIEF DESCRIPTION OF THE DRAWINGS

Other objects and advantages of the invention will become apparent upon reading the following detailed description and upon reference to the drawings in which.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE INVENTION

Figure 1:
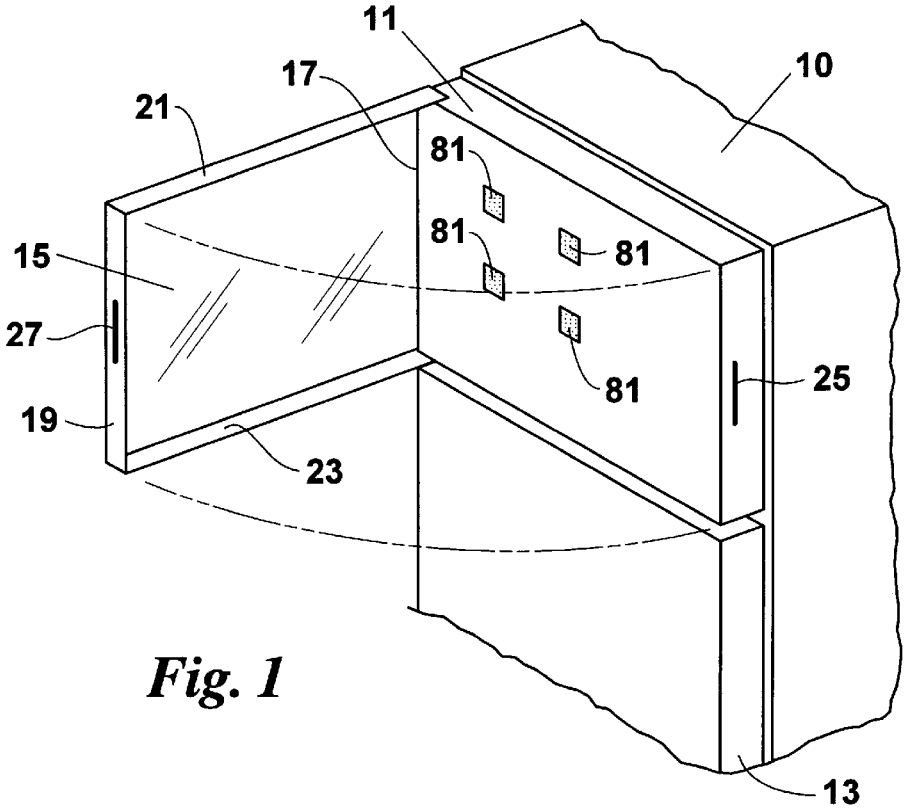
FIG. 1 is a perspective view illustrating an upright refrigerator/freezer mounting of the display lens.

Turning first to FIG. 1, a typical upright refrigerator/freezer 10 has a freezer door 11 above a refrigerator door 13. A lens 15 is hinged along one edge of the freezer door 11 for rotation into and out of laminar contiguous relationship therewith. The hinge 17 may be a piano type or any other suitable hinge. While the lens 15 may be hinged along any edge of the freezer door 11, the hinge 17 will preferably extend along the same edge at which the freezer door 11 is hinged to the refrigerator 10. If, as shown, the lens 15 fully covers the front face of the freezer door 11, it is also preferred that the non-hinged edges of the lens 15 be provided with orthogonal faces 19, 21 and 23 to cover the vertical and horizontal portions of the freezer door 11 to which the hinge 17 is not connected. Preferably, the lens 15 can be latched in a closed laminar relationship to the freezer door 11 by any known latching arrangement. As shown, a seat 25 in the vertical face of the freezer door 11 opposite the hinge 17 engages with a complementary interior ridge 27 provided on the vertical face 19 on the lens 15. However, latching could be accomplished by any suitable engagement of any face of the lens 15 with a common face of the freezer door 11.

Figure 2:
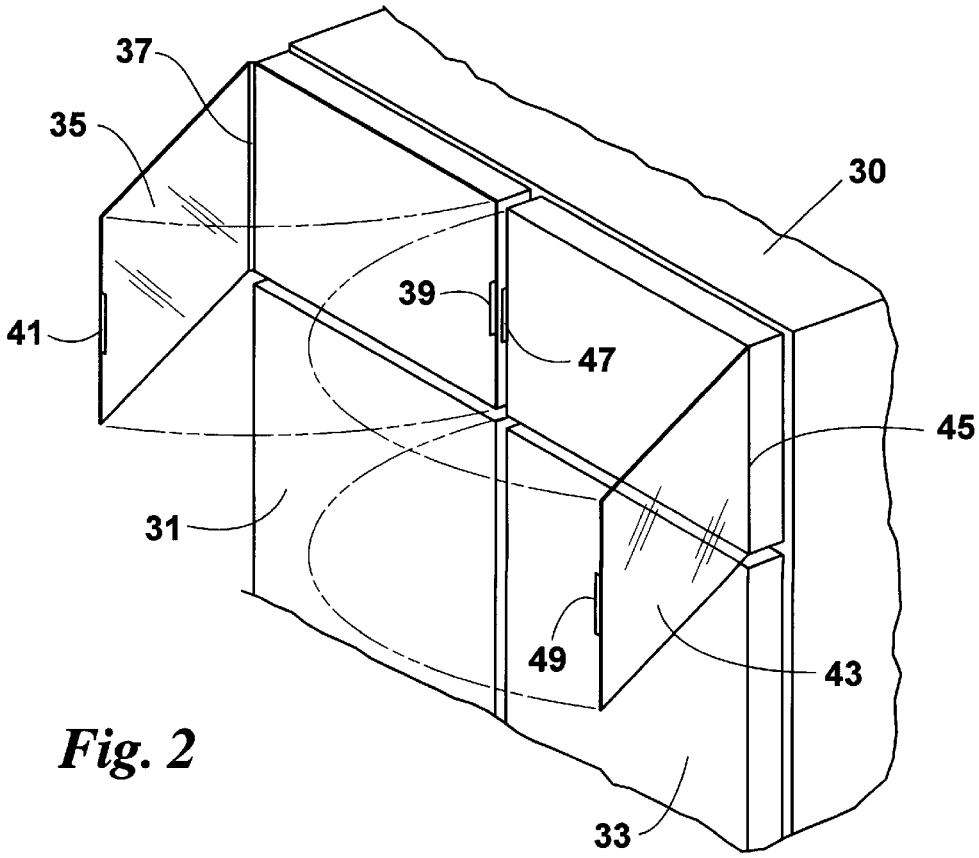
FIG. 2 is a perspective view of a side-by-side refrigerator/freezer mounting of the display lens.

Turning now to FIG. 2, a side-by-side refrigerator/freezer 30 has a freezer door 31 and a refrigerator door 33. A first laminar lens 35 is hinged along the outer vertical edge of the freezer door 31 by a piano-type hinge 37 or other known suitable hinging mechanism. As shown, the lens 35 extends entirely across the freezer door 31, but only covers a portion of its vertical height. As much of the freezer door as desired in either a horizontal or vertical direction may be covered by the lens 35. Preferably, if less than the entire freezer door 31 is to be covered by the lens 35, the freezer door 31 will be formed with an inset as required so that the front face of the lens 35 will lie in the same plane as the front face of the non-inset portion of the freezer door 31. The lens 35 may be secured in place against or flush with the front face of the freezer door 31 by complementary door and lens latching mechanisms 39 and 41 which are shown disposed on the front face of the door 31 and the rear face of the lens 35, though other latching arrangements could certainly be used. The refrigerator door 33 is also provided with a lens 43 connected by a hinge 45 to the refrigerator door 33. As shown, complementary latching mechanisms 47 and 49 on the refrigerator door 33 and the lens 43, respectively, will secure the lens 43 in laminar relationship against the refrigerator door 33. The variations suggested relative to the freezer door 31 are also applicable to the refrigerator door 33.

Figure 3:
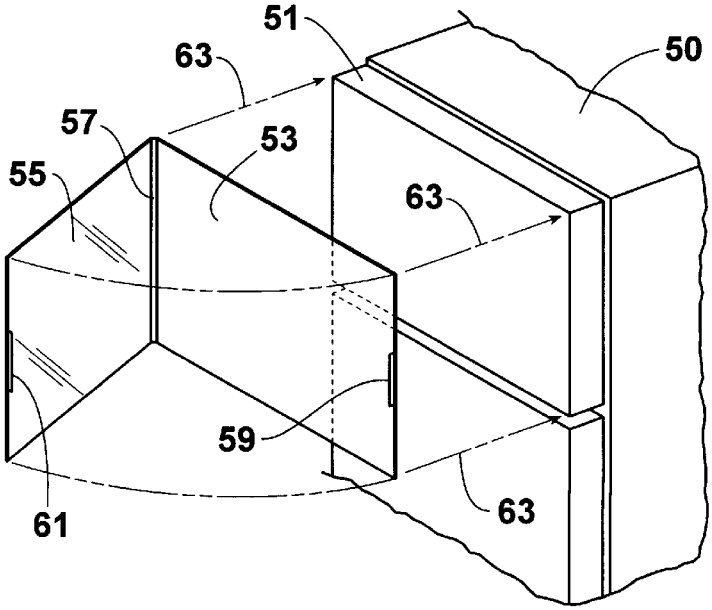
FIG. 3 is a perspective view illustrating an aftermarket version of the refrigerator/freezer display lens.

Looking now at FIG. 3, an existing refrigerator 50 with a typical known refrigerator/freezer door 51 is illustrated to which an aftermarket lens assembly can be attached. As shown, the lens assembly consists of a backing sheet 53 of relatively rigid material such as plastic, aluminum, sheet metal or magnetic material and a lens 55 connected to the backing sheet 53 by a hinge 57 along one of their common edges. While a piano type hinge is preferred, any suitable known hinge could be used for the purpose. Mating latching mechanisms 59 and 61 are provided on the backing sheet 53 and the lens 55, respectively, so as to permit the lens 55 to be secured in a closed laminar relationship relative to the backing sheet 53. The backing sheet 53 may be secured by the user to the front face of the refrigerator/freezer door 51 by any suitable meary 63 such as double backed tape, magnets and the like, preferably at the four corners of the backing sheet 53, as is illustrated. The backing sheet 53 need not be the same size as the lens 55, though such an arrangement is preferred. As shown, the backing sheet 53 and lens 55 may extend entirely across the width of the refrigerator 50, though this is not necessary, and may extend for the full height of a door on a refrigerator 50, though this also is not necessary.

Figure 4:
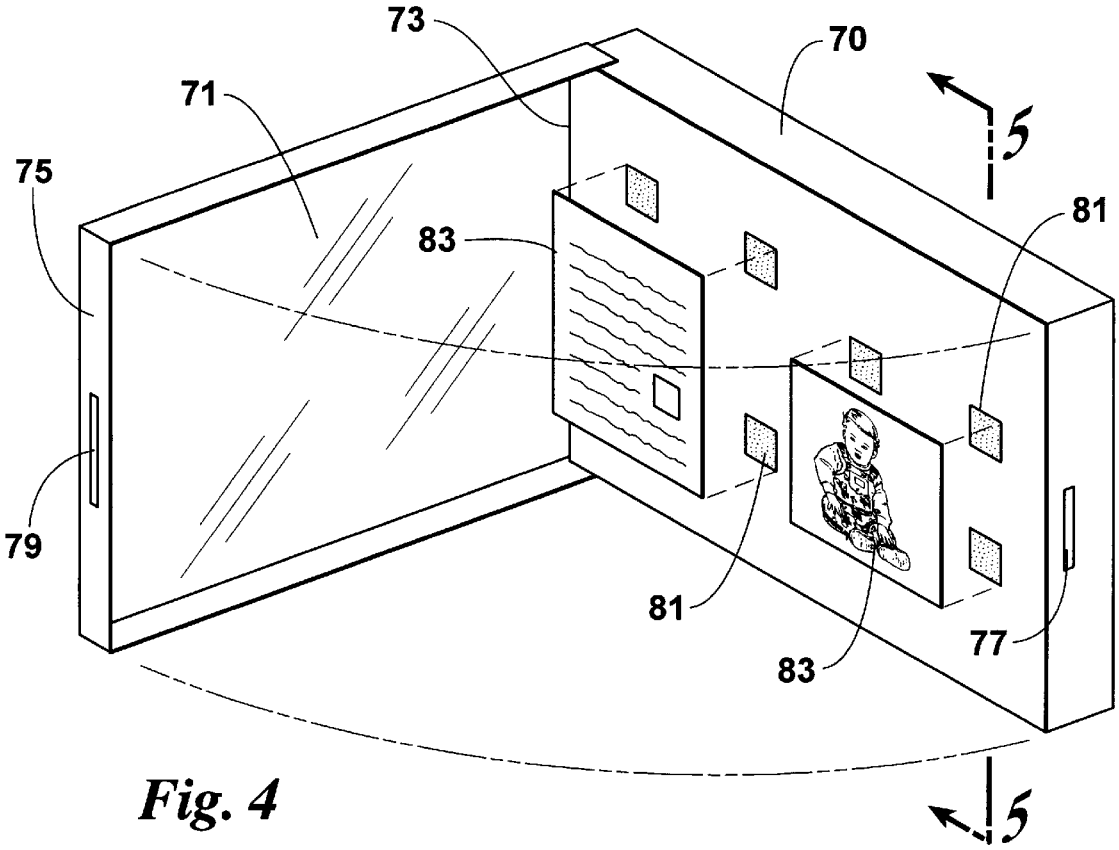
FIG. 4 is a perspective view illustrating an arrangement of display materials in relation to the display lens.
Figure 5:
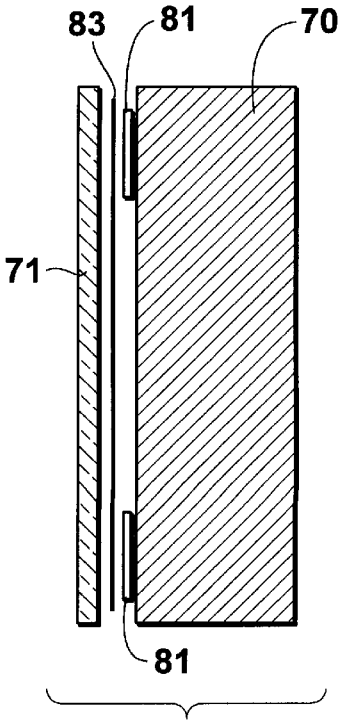
FIG. 5 is a cross-sectional view taken along the line 5—5 of FIG. 4 except that the display lens is in a closed condition.

Looking now at FIGS. 4 and 5, operation of the refrigerator door display lens is illustrated. With the lens 71 connected to the door 70 by a hinge 73, pieces of, double backed tape, magnetic material or other attaching means 81 are applied to the lens 71 or, preferably, the door 70. The printed materials 83 can then be secured in place by adhering the front or back faces of the printed materials 83 to the adhesive or other adhering means 81. With the printed matter 83 held in its desired position, the lens 71 is rotated about the hinge 73 into a closed condition, pinning or securing the printed materials 83 against the adhesive material 81, all in laminar contiguous relationship. As shown in FIG. 4, a vertical sheet 75 preferably extends along the edge of the lens 71 opposite the hinge 73 and complementary latching mechanisms 77 and 79 on the side edge of the door 70 and on the vertical sheet 75, respectively, secure the lens 71, the materials 83 the adhesive 81 and the door 70 in this contiguous laminar relationship.

The lens can be made of clear plastic, Plexiglas or any other suitable transparent "unbreakable" material. Any portion of any door on a refrigerator/freezer could be inset and the lens hinged within the inset so as to maintain a single plane front face for the overall door. Any type of latch can be applied and any edge of the lens may be hinged, so that the lens may open to the right, to the left, upwardly or downwardly.

Thus, it is apparent that there has been provided, in accordance with the invention, a refrigerator door display lens that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A device for securing in place and protecting articles for display on a refrigerator/freezer door having a front face and another face substantially orthogonal to the front face comprising:

a transparent rectangular panel contoured for flush laminar orientation over at least a portion of the front face of the rectangular refrigerator/freezer door;

a hinge disposed along one edge of said transparent panel permitting said transparent panel to be rotated into and out of flush laminar relationship against the at least a portion of the front face of the refrigerator/freezer; and a substantially otyhogonal face along another edge of said transparent panel opposite said hinged edge for juxtaposition against the another face of the refrigerator/freezer door when said panel is in flush laminar relationship with the at least a portion of the front face of the refrigerator/freezer door, said hinge and said substantially orthogonal face being cooperable to secure said panel to the refrigerator/freezer door in flush laminar relationship against the at least a portion of the front face of the refrigerator/freezer door with the articles for display sandwiched therebetween.

2. A device according to claim 1 further comprising means for adhering the articles for display to said at least a portion of the front face of the refrigerator/freezer door.

3. A device for securing in place and protecting articles for display on a refrigerator/freezer door having a front face and another face substantially orthogonal to the front face comprising:

a transparent rectangular panel contoured for flush laminar orientation over at least a portion of the front face of the refrigerator/freezer door;

a hinge disposed along one edge of said transparent panel permitting said transparent panel to be rotated into and out of flush laminar relationship against the at least a portion of the front face of the refrigerator/freezer door; and a substantially orthogonal face along another edge of said transparent panel opposite said hinged edge for juxtaposition against the another face of the refrigerator/freezer door when said panel is in flush laminar relationship with the at least a portion of the front face of the refrigerator/freezer door, said hinge and said substantially orthogonal face being cooperable to secure said panel to the refrigerator/freezer door in flush laminar relationship against the at least a portion of the front face of the refrigerator/freezer door with the articles for display sandwiched therebetween.

4. A device according to claim 3, said transparent panel substantially orthogonal face and the refrigerator/freezer door substantially orthogonal face having a complimentary seat and ridge for detachably latching the panel to said door.

5. A device for securing in place and protecting articles for display on a refrigerator/freezer door having a front face and another face substantially orthogonal to the first face comprising:

a transparent rectangular panel contoured for flush laminar orientation over at least a portion of the front face of the refrigerator/freezer door;

a hinge disposed along one edge of said transparent panel permitting said transparent panel to be rotated into and out of flush laminar relationship against the at least a portion of the front face of the refrigerator/freezer door; and substantially orthogonal faces along each other edge of said transparent panel which are juxtaposed against corresponding faces of the refrigerator/freezer door, said hinge and said substantially orthogonal face being cooperable to secure said panel to the refrigerator/freezer door in flush laminar relationship against the at least a portion of the front face of the refrigerator/freezer door with the articles for display sandwiched therebetween.

6. For securing in place and protecting articles for display, a refrigerator/freezer door comprising:

a rectangular door having a front face and substantially orthogonal side faces along a perimeter thereof;

a transparent panel contoured for flush laminar disposition on at least a portion of said front face of said door;

a hinge disposed along one edge of said transparent panel permitting said transparent panel to be rotated into and out of flush laminar relationship against said portion of said front face of said door; and a substantially orthogonal face along another edge of said transparent panel opposite said hinged edge which is juxtaposed against another face of said refrigerator/freezer door substantially orthogonal to said first face of the refrigerator/freezer door when said panel is in flush laminar relationship with said at least a portion of said front face of the refrigerator/freezer door, said hinge and said substantially orthogonal face being cooperable to secure said panel to said door in flush laminar relationship against said portion of said front face of said door with the articles for display sandwiched therebetween.

7. A device according to claim 6 further comprising means for adhering the articles for display to said portion of said front face of said door.

8. For securing in place and protecting articles for display, a refrigerator/freezer door comprising:

a planar rectangular door having a front face and substantially orthogonal side faces along a perimeter thereof;

a planar rectangular transparent panel sized to cover said front face of said door;

a hinge disposed between one edge of said transparent panel and a corresponding edge of said door permitting said transparent panel to be rotated into and out of flush laminar relationship against said front face of said door; and substantially orthogonal faces along each other edge of said transparent panel which are juxtaposed with corresponding faces of said door when said panel is in flush laminar relationship with said front face of said door, said hinge and said substantially orthogonal face being cooperable to secure said panel to said panel to said door in flush laminar relationship with the articles for display sandwiched therebetween.

9. A device according to claim 8 further comprising means for adhering the articles for display to said front face of said door.

10. A device according to claim 8, said securing means comprising a hinge disposed between one edge of said transparent panel and a corresponding edge of said door permitting said transparent panel to be rotated into and out of laminar relationship against said front face of said door.

* * * * *